US005539952A

United States Patent [19]

Hayes et al.

[11] Patent Number: 5,539,952

[45] Date of Patent: Jul. 30, 1996

[54] FLUID HANDLING APPARATUS FOR MAINTAINING LITHOGRAPHIC PRESSES

[76] Inventors: Thomas Hayes; Patrick Maiello, both of c/o Varn Products Co., Inc. P.O. Box 1101 8 Allerman Rd., Oakland, N.J. 07436

[21] Appl. No.: 293,714

[22] Filed: Aug. 22, 1994

[51] Int. Cl.[6] ..... A47L 7/00

[52] U.S. Cl. ..... 15/321

[58] Field of Search ..... 15/320–322, 346, 15/345; 134/103.1, 104.2, 900; 239/373, 119, 120

[56] References Cited

U.S. PATENT DOCUMENTS

| | | | |
|---|---|---|---|
| 1,940,539 | 12/1933 | Fritche | 15/302 |
| 1,986,476 | 1/1935 | Ironside | 15/409 X |
| 2,707,874 | 5/1955 | Glover | 15/409 X |
| 3,452,751 | 7/1969 | Austin | 15/409 X |
| 3,557,817 | 1/1971 | Royse | 137/91 |
| 3,687,729 | 8/1972 | Winburn et al. | 15/302 X |
| 4,300,450 | 11/1981 | Gasparrini | 101/364 |
| 4,446,590 | 5/1984 | Kirchner | 15/302 |
| 4,608,158 | 8/1986 | Ghisalberti | 210/96.1 |
| 4,867,380 | 9/1989 | Sibbertsen | 239/DIG. 21 |
| 5,103,730 | 4/1992 | Sarda | 101/425 |

*Primary Examiner*—Kevin P. Weldon
*Attorney, Agent, or Firm*—James W. Jakobsen

[57] ABSTRACT

The present invention is an air operated fluid handling apparatus for cleaning lithographic presses. It provides a printing press operator with a device for both dispensing ink solvents and removing spent fluids used in the printing process. Compressed air is regulated and directed to a T-section connector. One conduit extends from the connector to provide pressure in an ink-solvent container. Another conduit extends from the connector to a venturi which is used to create a vacuum in a used-fluid container. A conduit extends from each container and connects to a light weight flexible hose. Connected to the opposite end of the flexible hose is a valve and nozzle assembly that allows the press operator to alternate between dispensing ink solvent and remove spent fluid. With this apparatus the press operator can effectively move from printing head to printing head dispensing ink solvent and removing used fluids as necessary for ink train and dampening system cleanup.

14 Claims, 3 Drawing Sheets

FLUID HANDLING APPARATUS FOR MAINTAINING LITHOGRAPHIC PRESSES

BACKGROUND OF THE INVENTION

1. Field of the Invention

The present invention relates generally to equipment for cleaning printing presses. It more particularly relates to equipment for cleaning inking and dampening systems of printing presses.

2. Description of the Prior Art

The typical offset lithographic printing press consists of several main components, namely; a paper feed and deliver system; plate, impression and blanket cylinders; an ink train; a dampening system; and the drive gearing associated with the previously named components. A single printing head consists of all but the feed and delivery systems. Presses have anywhere from one to six printing heads. A particularly laborious aspect of running a press is cleaning the printing heads alter each job. The ink train and dampening is system are the most time consuming to clean. To help better understand why it takes such great effort to clean these systems I will briefly describe the makeup of the typical ink train and dampening systems in use today. After these descriptions I will explain the procedure followed when cleaning the ink train and dampening systems of a press. And finally, the aspects of the cleaning procedure that would be improved through use of the invention described herein will be explained.

Most ink trains are comprised of a chromed ink roller having a doctor blade against its periphery for regulating ink feed, several inking rollers which mill the ink to a thin film, and inking form rollers that evenly distribute the ink film onto a printing plate. Created between the doctor blade and the chromed ink roller is an ink reservoir. Prior to printing a printer will fill this reservoir with the amount of ink needed for the particular printing job. At the end of the job the ink must be removed from the ink reservoir and ink train. An ink blade and washup tray is used for cleaning the ink train.

There are several basic types of dampening systems. A conventional dampening system has one pan roller, usually rotating at less than press speed, picking up the dampening fluid from a dampening fluid pan. The dampening fluid is transferred to a set of dampening rollers by a ductor roller that alternately contacts the pan roller and set of dampener rollers. The set of dampening rollers smooth out the fluid to a consistent thickness and deposit it onto the printing plate prior to the plate passing the inking form rollers, thus, ensuring that the non-image area of the plate stays clear of ink.

Another type of dampening system is a continuos type dampening system. Like the conventional system, this system uses a pan as a reservoir and has a pan roller and a set of dampening rollers. However, instead of the fluid being transferred periodically by a ductor roller, the fluid is transferred directly by a continuously rotating metering roller. Most continuos type dampening systems have a pan roller running at less than press speed, lo therefore, there is a speed differential between at least two, but sometimes several or all of the dampening system rollers.

Both the conventional and continuos type dampening systems require anywhere from 5% to 15% alcohol in the fountain solution to properly wet the plate.

The third type of dampening system consists of only two rollers-a dampening form is roller and a metering roller. Both rollers will usually rotate at press speed. Unlike the conventional and continuos type dampening systems, this third type of dampener does not have a fountain solution pan. Instead, a reservoir of fountain solution is maintained in the nip between the two rollers and a set of end seals.

In regard to dampener system maintenance there are several characteristics inherent to all of the above described dampening systems. First, each system has some type of dampening fluid reservoir that must be drained at the end of the printing operation. In addition, after the fountain solution has been drained from the reservoir, some or all of the rollers of each system must be cleaned of ink with an ink solvent. And, depending on the particular configuration of the dampener, the reservoir must again be drained of spent ink solvent.

Cleaning a single head of a press typically involves the following steps: (1)removing unused ink from the doctor blade/chromed ink roller reservoir and cleaning said blade/roller reservoir by hand, (2)removing unused dampening fluid from the dampening system reservoir, (3)engaging the inker cleanup blade and washup tray against one of the lower inker rollers, (4)applying ink solvent to the inking and dampening rollers, (5)removing the solvent from the washup tray and dampener reservoir after it has reduced and washed away the spent ink from the inking and dampening rollers, and (6)manually wiping down any rollers requiring special attention such as the blanket cylinder, impression cylinder, chromed ink roller, and dampening pan roller.

To apply ink solvent to the inking and dampening rollers as described above in step (4) printers will usually fill a small plastic squeeze bottle with ink solvent and squirt the solvent onto the ink and dampener rollers. Several drawbacks of this method are: a) the squeeze bottle must be refilled frequently, b) the squeeze bottle is not easy to manipulate, and c) the squeeze bottle will more often than not leak ink solvent onto the press operator's hands. There are systems for dispensing ink solvents onto the ink and dampener rollers, however, they tend to be expensive, inflexible, and complicated to operate. An example of such a system is Sarda's apparatus for cleaning and maintaining a printing press, U.S. Pat. No. 5,103,730.

To remove the used fountain solution or spent ink solvent as described above in steps (2) and (5) above the printer must remove the pan or washup tray from the press and dump its contents into a storage container or suction the fluid from the pan or washup tray using a plastic squeeze bottle. Both methods are awkward and often result in spilling the used fountain solution and/or spent ink solvent. There are other types of suction devices used by printers to extract spent fluids from the press, however, they are usually powered by electricity and because of this create a shock hazard to the operator. In addition, since most ink solvents are volatile, use of these devices creates the risk of explosion. Some fountain pans have recirculating systems attached which allow for draining of the fountain solution from the pan to a central fountain solution reservoir after the print job has been completed. An example is Gasparrini's liquid circulating system, U.S. Pat. No. 4,300,450. These systems cannot be used as a drain for the spent ink solvents, however, because the central fountain solution reservoir would become contaminated. Depending on the number of jobs run and the number of printing heads printed on during each job, a printer will be required to clean anywhere from one to eighteen printing heads a day. To clean one head takes approximately ten to fifteen minutes.

From the above is can be understood that the process of cleaning a press takes a considerable amount time and effort.

In addition, the process often requires the printer to be exposed to dampening fluids and ink solvents. Any step in the cleaning process that would reduce the time and effort to clean a press and reduce the printers exposure to printing fluids would be of great benefit.

For example, if the time it takes to clean a press could be reduced it would allow more time for printing jobs. This would immediately make the press more economical to run and, thus, make the printer more competitive in the marketplace. Also, if the process of cleaning the press could be simplified to any degree, the printer would experience less fatigue. And because there are many dangers within the printing environment-for example; inward nips, rotating gears and numerous pinching locations-any reduction in operator fatigue would translate to a safer working environment because the printer would remain more alert while operating the press. In addition, because the present method of cleaning a press requires the use of ink solvents and the method of applying these solvents often results in the operator's hands being exposed to the solvents, eliminating exposure would tend to reduce the health risks experienced by a printer.

One area which has received little attention in the past is a quick and convenient apparatus for dispensing ink solvents used to clean the inking and dampening systems and a quick and convenient apparatus for removing used fountain solution and spent ink solvents from the dampening system reservoir and ink washup tray. Such a system would considerably reduce the time it takes to perform three of the six basic steps followed when cleaning a printing press. In addition, it would improve the economics in running a press, reduce fatigue, increase the safety of operating a press, and reduce the health risks associated with handling ink solvents.

SUMMARY OF THE INVENTION

The invention described in detail below is an air operated ink-solvent dispenser and used-fluid removal system. It provides a single location for replenishing the ink solvents used to clean the ink and dampener rollers and provides a single location for the collection of spent fluids used in the printing process. In addition, my invention utilizes a lightweight fluid conduit and hand operated valve and nozzle assembly that allows the primer to quickly move from priming head to printing head dispensing ink solvent and removing used fluids as necessary for ink train and dampening system cleanup.

One object of my invention is to reduce the amount of time it takes to remove used fountain solution and spent ink solvent from the dampener system reservoir and to reduce the amount of time is takes to remove spent ink solvent from the inker washup tray.

Another object my invention is to simplify the method of applying ink solvent to the inking and dampening rollers when they are to be cleaned of ink.

Still another object of the invention is to reduce the press operators exposure to ink solvents and, therefore, reduce tile degree of health risk associated with such exposure.

A further object is to provide a solvent handling device that requires no electrical power to operate and, therefore, eliminates the possibility of electrical shock and explosion.

Other objects and advantages of the invention will be apparent from the following description, the accompanying drawings, and the appended claims.

BEST MODE FOR CARRYING OUT THE INVENTION

The invention will now be illustrated further with respect to the drawings.

Figure 2:
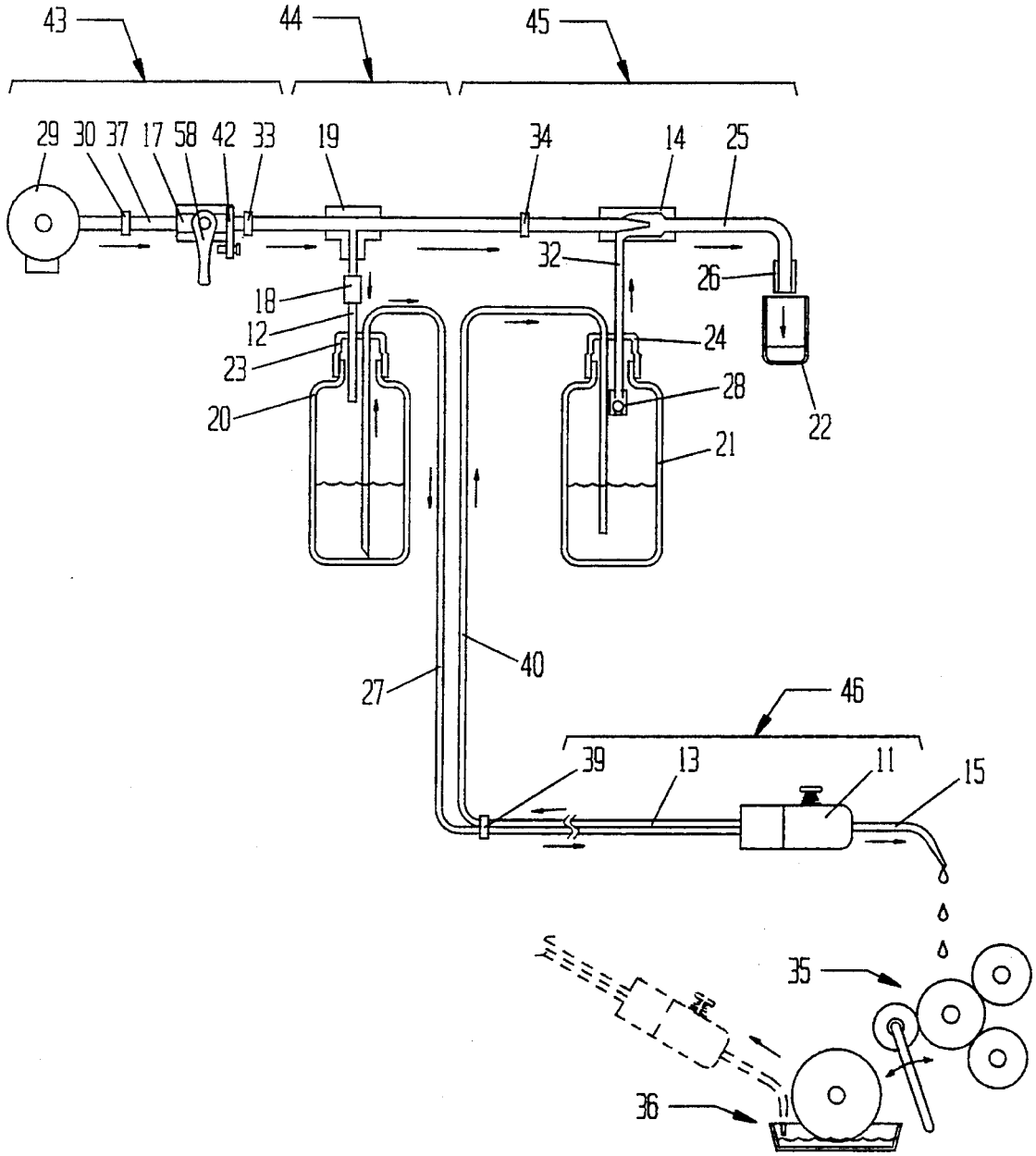
FIG. 2 is a schematic view of the ink-solvent dispensing and fluid removal cleaning system showing the alternate uses of the fluid handling assembly.
Figure 4:
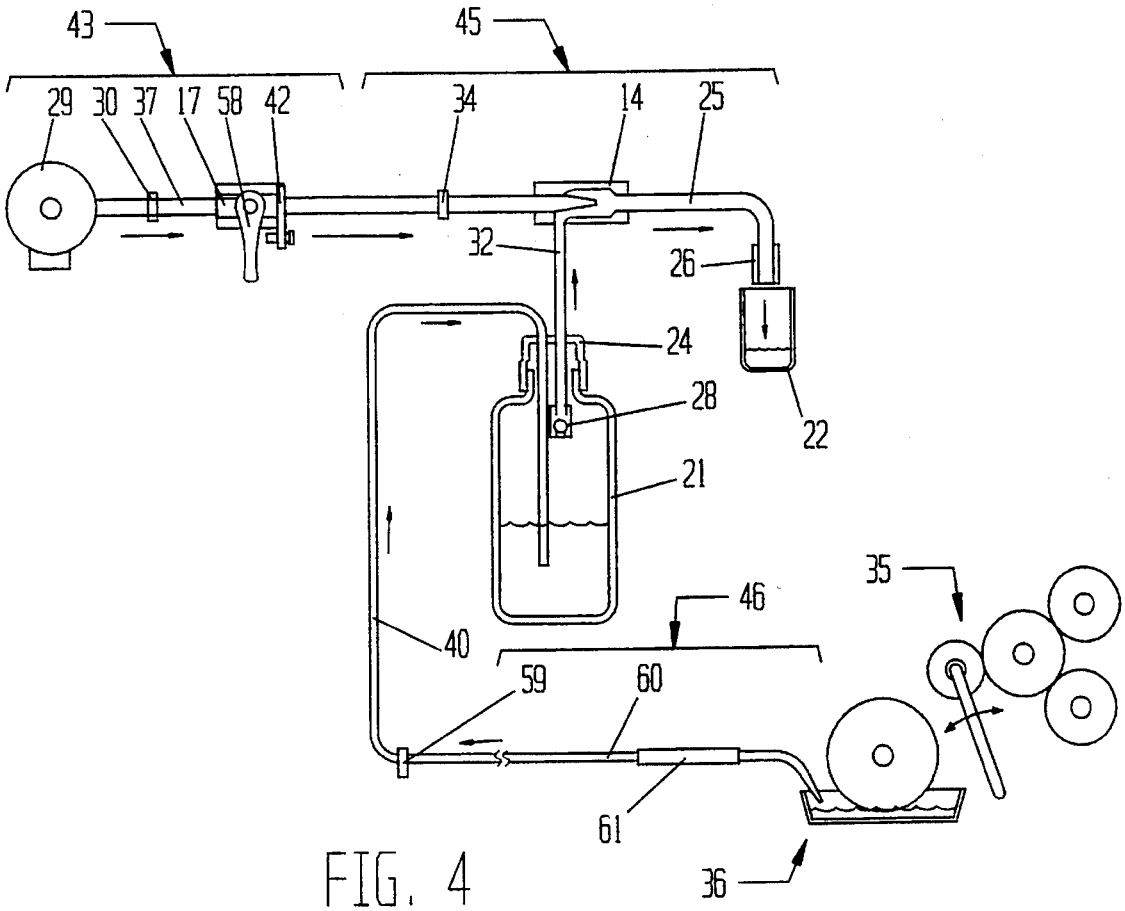
FIG. 4 is an schematic view of an alternate embodiment of my invention that does not include the ink-solvent dispensing components and its associated fluid handling assembly components.

As shown in FIG. 2 the invention can be broken down into four main components: air supply and flow controls, shown generally at 43; ink-solvent dispensing components, shown generally at 44; fluid removal components, shown generally at 45; and fluid handling assembly, shown generally at 46. To better understand the application of the invention disclosed below, FIG. 2 and FIG. 4 show a conventional dampener with dampening rollers 35, a fountain reservoir 36, and my invention in relation thereto when in use.

Figure 1:
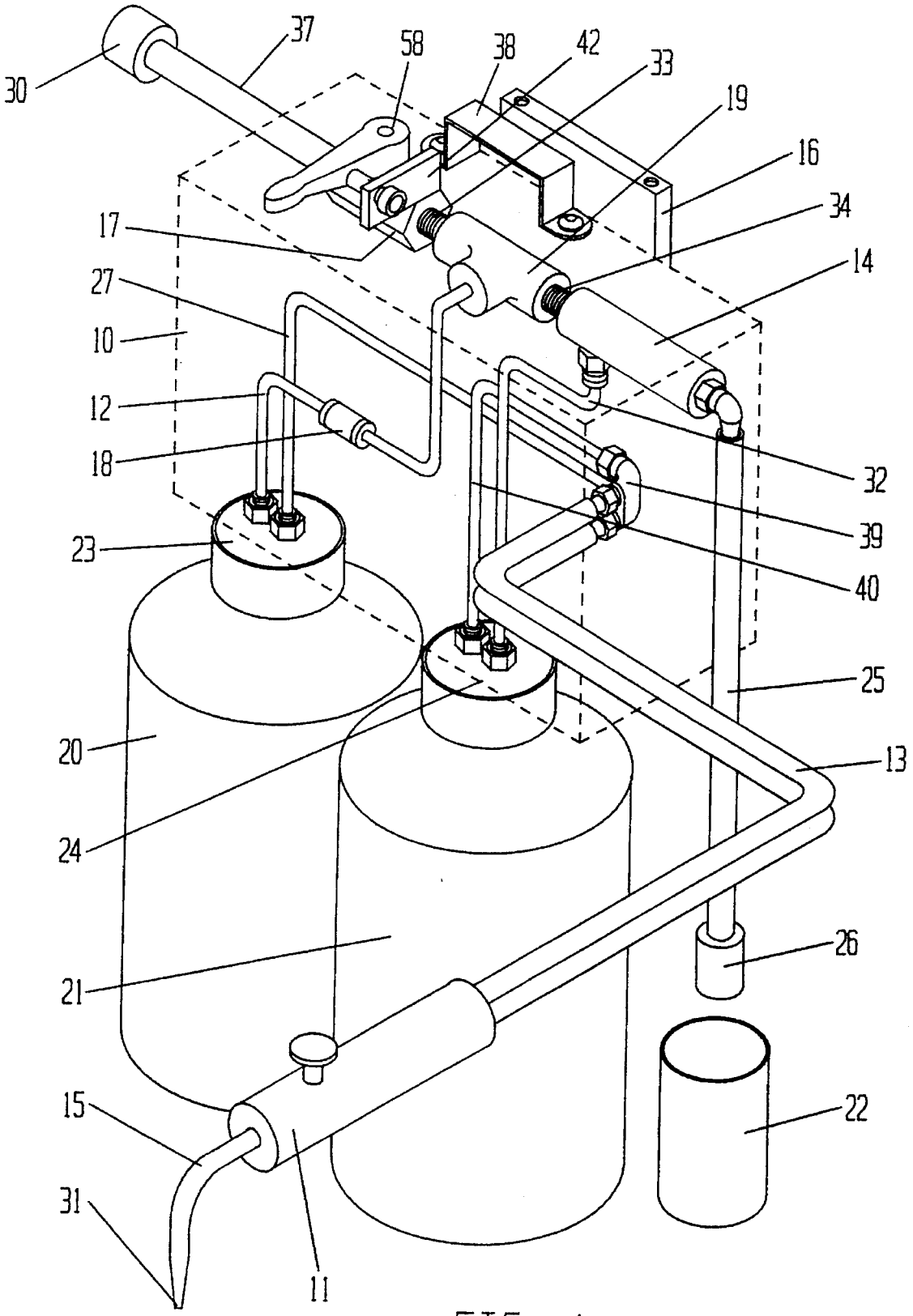
FIG. 1 is a perspective view of the ink-solvent dispensing and fluid removal cleaning system with the enclosure shown as dotted lines to assist in clarity.

Referencing FIG. 1 and FIG. 2, pressurized air is supplied by an air compressor 29, through the compressor's output connection, to an air supply inlet coupling 30. Inlet coupling 30 is attached to an air supply conduit 37. Coupling 30 may be any conventional type of coupling such as a threaded or a press on type fitting.

In line with air supply conduit 37 is a ball valve 17 having a handle 58. Said ball valve 17 is used to admit, close off, or regulate the flow of air from air compressor 29 to the system. An adjustable stop 42 is provided on ball valve 17 to allow the operator to set the is air flow best suited for his particular cleaning system configuration. For example, to compensate for compressor output that differs from shop to shop.

Air leaving ball valve 17 passes through a system restricter 33 which allows a fixed reduction of line flow for those shops with higher than nominal air pressure.

Following system restricter 33 is a T-section conduit connector 19 having three orifices. The T-section conduit is intended to split the air flow between ink-solvent dispensing components 44 and fluid removal components 45.

Ink-solvent dispensing components 44 are constructed as follows. An ink-solvent container 20 is connected to an ink-solvent container cap 23. Container 20 is pressurized by line pressure supplied through a pressure supply conduit 12 located between the second orifice of T-section conduit connector 19 and ink-solvent container cap 23. Because container 20 will be used to store ink solvents, it is important that it is resistant to chemical attack by these solvents.

To prevent excessive ink-solvent flow out of ink-solvent container 20 caused by over pressurization of said container, a pressure regulator 18 may be provided in ink-solvent container pressure supply conduit 12. The addition of pressure regulator 18 will depend on such factors as line pressure and conduit lengths. Increased control of bottle pressurization can be accomplished by including an adjustable type of pressure regulator.

It should be noted at this point that although the description of the invention describes container 20 as an ink-solvent container, this container can be used to contain any variety of cleaning fluids available on the market to facilitate cleaning of the press.

Extending from just above the bottom of ink-solvent container 20 and through threaded cap 23 is an ink-solvent supply conduit 27. Said conduit extends and is secured to one of two couplings of a double conduit connector 39. This connector is then connected to a double conduit hose 13.

Fluid removal system 45 is constructed as follows. A venturi 14, having a pressure supply port, a suction port, and an exhaust port, is connected by its pressure supply port to the third orifice of T-section conduit connector 19. A vacuum is created in a used-fluid container 21 by connecting a venturi intake conduit 32 to used-fluid container cap 24 and the suction port of venturi 14. It is important that used-fluid container 21 be crush-proof because of the vacuum created at the venturi's suction port once air is emitted through venturi 14. In addition, used-fluid container 21 should be resistant to chemical attack by inks, ink solvents, fountain solutions, and alcohol. Fluid may be prevented from entering venturi intake conduit 32 by attaching a ball float type check valve 28 to the intake end of conduit 32. Adding check valve 28 eliminates the need for an overflow container 22 because when used-fluid container 21 fills to a predetermined level check valve 28 closes and venturi 14 is unable to draw fluid from its suction port.

Regulation of air flow through venturi 14 may be controlled by the addition of a venturi restricter 34 between T-section conduit connection 19 and venturi 14.

The exhaust port of venturi 14 discharges through an exhaust/overflow conduit 25 and to the atmosphere. To catch any overflow of used fluid that may occur due to overfilling of used-fluid container 21 overflow container 22 may be provided. In addition, the hissing noise characteristic of vented air may be significantly reduced by the addition of a noise suppressing filter 26 attached to the free end of exhaust/overflow conduit 25.

A used-fluid return conduit 40 runs from used-fluid container cap 24 to double conduit connector 39. This connector is in turn connected to double conduit hose 13.

Double conduit hose 13 has a figure eight cross section, thereby, providing two fluid passageways-one for ink-solvent dispensing and one for used-fluid removal. In addition, the hose is light weight and easy to manipulate. The length of double conduit hose 13 may be varied and is determined by the extent to which the hose must reach.

Figure 3:
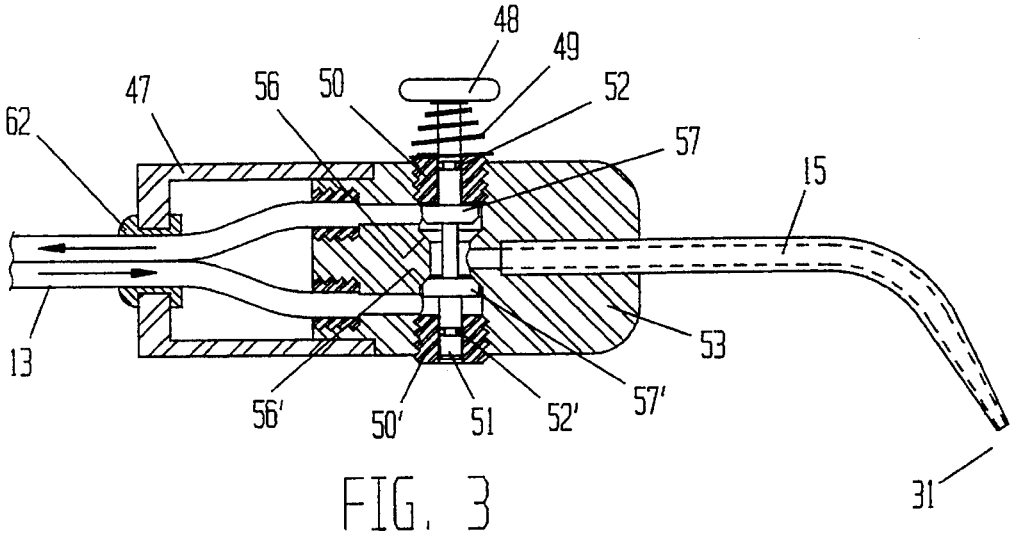
FIG. 3 is a sectional view of the valve and nozzle assembly that is shown in FIG. 1 and FIG. 2.

Connected to double conduit hose 13, on the end opposite double conduit connector 39 is a valve and nozzle assembly 11. Referring to FIG. 3 it can be seen that double conduit hose 13 splits at the opposite end and may be secured in a conventional manner, such as by tube type compression fittings or banding, to a valve body 53. Protecting these connections is a cover 47. Providing strain relief to double conduit hose 13 is a strain relief 62. Said cover 47 may be secured to valve body 53 by threads. Lateral to the axis of valve body 53 is a through hole configured to accept a valve stem 51. Said stem 51 includes an upper and lower sealing disk 57, 57' and a stem button 48. Said stem 51 is maintained in a concentric position with the through hole by upper and lower threaded collars 50, 50'. Sealing between said stem 51 and collars 50, 50' is made by upper and lower stem seals 52, 52'. Said stem 51 is maintained in an uppermost position by compression spring 49, compressed between stem button 48 and upper threaded collar 50, biasing stem 51 upward. This uppermost position is the normal position of valve stem 51. In this position ink-solvent solution is prevented from flowing through valve body 53 because lower sealing disk 57' is seated against a lower seal seat 56'. By design, a communication passage is created between the suction side of double conduit hose 13 and a nozzle 15 because upper sealing disk 57 is unseated from an upper seal seat 56. The operator will utilize the invention with the valve in this normal position to remove used fluids from the ink cleanup tray and dampener reservoir. Upon depressing stem button 48 the suction side of double conduit 13 is sealed off since now upper seating disk 57 is seated against upper seal seat 56. Simultaneously, ink-solvent solution is allowed to flow through valve body 53, through nozzle 15, and out nozzle mouth 31 because now lower sealing disk 57' is unseated from lower seal seat 56'. The operator will utilize the invention with the valve in this alternate position to dispense ink solvent onto the inked inking and dampening rollers during roller cleanup.

As depicted in FIG. 2 and by the detailed explanation above it is now apparent how the invention serves the purpose of dispensing ink solvent fluids and suctioning off spent ink solvent and dampening fluids.

FIG. 1 shows how the invention may be packaged. All of the components except air supply inlet coupling 30, conduit 37, ball valve handle 58, ink-solvent container 20, used-fluid container 21, fluid handling assembly 46, exhaust/overflow conduit 25, noise suppressing filter 26, and overflow container 22 may be enclosed in an enclosure 10. Enclosure 10 may then either be secured permanently to a structure using an attachment plate 16 or carried from press to press by a carrying handle 38.

FIG. 4 shows an alternate embodiment of my invention. This embodiment may include three of the four main components named above, namely: air supply and flow controls, shown generally at 43; fluid removal components, shown generally at 45; and fluid handling assembly, shown generally at 46. For this alternate embodiment, it is not necessary to provide double conduit hose 13 and valve and nozzle assembly 11. Instead, used-fluid return conduit 40 is connected to a single conduit connector 59, which, in turn, is connected to a single conduit hose 60. Just as with double conduit hose 13, single conduit hose 60 is made of flexible and lightweight material and can be cut to the required length by the press operator. Connected to the other end of single conduit hose 60 is a nozzle and nozzle adapter handle 61. This alternate embodiment, although lacking ink solvent dispensing components 44 of the first embodiment described above, provides the printer with a much improved device for handling used printing fluids.

It should be understood that although specific embodiments of the invention have been described in detail herein, such descriptions are for purposes of illustration only and modifications may be made thereto by those skilled in the art that would fall within the scope of the invention.

What is claimed is:

1. A fluid handling apparatus for maintaining lithographic presses comprising:

a compressed air supply having an output connection; an air supply conduit connected at its first end to the output connection; a T-section conduit connector having three orifices, said T-section conduit connector being connected by its first orifice to the second end of the air supply conduit; a means for regulating the flow of compressed air to the T-section conduit connector located in the air supply conduit;

a pressure supply conduit connected at its first end to the second orifice of the T-section conduit connector; a cleaning-fluid container; a first container enclosure means coupled to the cleaning-fluid container for sealingly enclosing the cleaning-fluid container, said first container enclosure means being connected to the second end of the pressure supply conduit; a cleaning-fluid supply conduit having its first end extending through the first container enclosure means and into the cleaning-fluid container, said cleaning-fluid supply conduit having its second end connected to a first coupling of a double conduit connector;

a venturi, said venturi having a pressure supply port, a suction port, and an exhaust port, said venturi being connected by its pressure supply port to the third orifice of the T-section conduit connector; an exhaust/overflow conduit having its first end connected to the exhaust port of the venturi, said exhaust/overflow conduit having its second end open to the atmosphere; a venturi intake conduit connected at its first end to the suction port of the venturi; a crush-proof used-fluid container; a second container enclosure means coupled to the used-fluid container for sealingly enclosing the used-fluid container, said second container enclosure means being connected to the second end of the venturi intake conduit; a used-fluid return conduit having its first end extending through the second container enclosure means, said used-fluid return conduit having its second end connected to a second coupling of the double conduit connector;

a flexible double conduit hose having two fluid passageways, said first passageway being connected to the first coupling of the double conduit connector and said second passageway being connected to the second coupling of the double conduit connector; a nozzle; and a means for alternating the free flow of fluid between each of the fluid passageways and the nozzle, said means having a first end and a second end, said means being connected by its first end to the second end of the double conduit hose, said means having the second end connected to the nozzle, said means having a normal position, said normal position closing off the passageway between the first passageway of the double conduit hose and the nozzle while permitting an open passageway between the second passageway of the double conduit hose and the nozzle.

2. The apparatus as claimed in claim 1 wherein the means for alternating the free flow of fluid between each of the fluid passageways and the nozzle comprises:

a valve body having an outer periphery, a first end and a second end; said valve body having a wall defining a passageway extending laterally through the axis of the valve body; said valve body having a wall lying on the valve body axis and defining a common conduit extending from the lateral passageway to the second end of the valve body; a first and second seal seat integral with the lateral passageway wall, each located opposite the other and radially outward from the common conduit; said valve body having walls defining a first and second conduit extending from the first end of the valve body to the lateral passageway, said first conduit piercing the lateral passageway radially outward the first seal seat and said second conduit piercing the lateral passageway radially outward the second seal seat;

a means for connecting the first passageway of the double conduit hose to the first conduit of the valve body and for connecting the second passageway of the double conduit hose to the second conduit of the valve body;

a valve stem located concentrically through the lateral passageway of the valve body; a means located on the ends of the valve stem and radially outward the first and second valve body conduits for maintaining the concentric location of the valve stem and for slideably sealing the valve stem; a first sealing disk attached integrally to the valve stem and located between one of the stem locating means and the first seal seat and second sealing disk attached integrally to the valve stem and located between the other stem locating means and the second seal seat, said sealing disks being positioned on the stem so that either the first sealing disk can sealingly contact the first seal seat or the second sealing disk can sealingly contact the second seal seat; a means for biasing the valve stem so the first sealing disk sealingly contacts the first seal seat.

3. The apparatus as claimed in claim 2 further comprising a cover, said cover having a cover attaching means for attaching the cover to the first end of the valve body, and a strain relief attached to the cover to provide strain relief between the cover and the double conduit hose.

4. The apparatus as claimed in claim 1 wherein the means for regulating the flow of compressed air to the T-section conduit connector comprises a ball valve and a system restricter.

5. The apparatus as claimed in claim 1 further comprising a means for regulating cleaning-fluid container pressure, said means being located in the pressure supply conduit.

6. The apparatus as claimed in claim 1 further comprising a means for regulating the flow of compressed air to the venturi, said means being located between the T-section connector and the venturi.

7. The apparatus as claimed in claim 1 further comprising a means for suppressing noise associated with escaping air connected to the second end of the exhaust/overflow conduit.

8. The apparatus as claimed in claim 1 further comprising a means for preventing flow of liquid into the venturi intake conduit.

9. The apparatus as claimed in claim 1 wherein the cleaning fluid container is chemically resistant to cleaning solutions and the used-fluid container is chemically resistant to inks, cleaning solutions, fountain solutions, and alcohol.

10. A fluid handling apparatus for maintaining lithographic presses comprising:

a compressed air supply having an output connection; an air supply conduit connected at its first end to the output connection; a T-section conduit connector having three orifices, said T-section conduit connector being connected by its first orifice to the second end of the air supply conduit;

a pressure supply conduit connected at its first end to the second orifice of the T-section conduit connector; a cleaning-fluid container; a first container enclosure means coupled to the cleaning-fluid container for closing the cleaning-fluid container, said first container enclosure means being connected to the second end of the pressure supply conduit; a cleaning-fluid supply conduit having its first end connected to the first container enclosure means, said cleaning-fluid supply conduit having its second end connected to a first coupling;

a venturi, said venturi having a pressure supply port, a suction port, and an exhaust port, said venturi being connected by its pressure supply port to the third orifice of the T-section conduit connector; a venturi intake conduit connected at its first end to the suction port of the venturi; a crush-proof used-fluid container; a second container enclosure means coupled to the used-fluid container for closing the used-fluid container, said second container enclosure means being connected to the second end of the venturi intake conduit; a used-fluid return conduit having its first end connected to the second container enclosure means, said used-fluid return conduit having its second end connected to a second coupling;

a hose assembly having at least two fluid passageways, the first of said passageways being connected to the first coupling, and the second of said passageways being connected to the second coupling; and a means for alternating the free flow of fluid between each of the fluid passageways, said means having a normal position, said normal position causing the first passageway to be closed off while leaving the second passageway open.

11. The apparatus as claimed in claim 10 further comprising a means for regulating the flow of compressed air to the T-section conduit connector, said means being located in the air supply conduit.

12. The apparatus as claimed in claim 11 wherein the means for regulating the flow of compressed air to the T-section conduit connector comprises a ball valve and a system restricter.

13. The apparatus as claimed in claim 10 further comprising a means for regulating the cleaning-fluid container pressure, said means being located in the pressure supply conduit.

14. The apparatus as claimed in claim 10 further comprising a means for regulating the flow of compressed air to the venturi, said means being located between the T-section conduit connector and the venturi pressure supply port.

* * * * *